US008820881B2

(12) United States Patent
Wada

(10) Patent No.: US 8,820,881 B2
(45) Date of Patent: Sep. 2, 2014

(54) PRINTING APPARATUS AND METHOD

(75) Inventor: Itaru Wada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 13/534,989

(22) Filed: Jun. 27, 2012

(65) Prior Publication Data

US 2013/0027459 A1 Jan. 31, 2013

(30) Foreign Application Priority Data

Jul. 29, 2011 (JP) ..... 2011-166762

(51) Int. Cl.
*B41J 29/393* (2006.01)

(52) U.S. Cl.
USPC ..... 347/19; 347/17

(58) Field of Classification Search
CPC .. B41J 2/0454; B41J 2/04553; B41J 2/04563; B41J 2/0458; B41J 2002/14193; B41J 2002/14177
See application file for complete search history.

(56) References Cited

U.S. PATENT DOCUMENTS 7,278,729 B2 * 10/2007 Nakajima ..... 347/102
8,317,913 B2 * 11/2012 Hatada et al. ..... 106/31.59

FOREIGN PATENT DOCUMENTS

| | | | |
|---|---|---|---|
| CN | 1454780 | A | 11/2003 |
| CN | 1899822 | A | 1/2007 |
| CN | 101791905 | A | 8/2010 |
| JP | 2003-326680 | A | 11/2003 |
| JP | 4357796 | B2 | 11/2009 |

* cited by examiner

*Primary Examiner* — Lamson Nguyen
(74) *Attorney, Agent, or Firm* — Canon USA, Inc., IP Division

(57) ABSTRACT

A printing apparatus includes a printing unit, a heater, and a control unit. The printing unit prints an image on a sheet without an ink receiving layer by repeating scanning of a print head. The heater heats an area on the sheet to which ink is applied by the print head. The control unit controls output and drive timing of the heater based on a parameter for each scanning of the print head.

11 Claims, 11 Drawing Sheets

PRINTING APPARATUS AND METHOD

BACKGROUND OF THE INVENTION

1. Field of the Invention

The present invention relates to an inkjet printing apparatus for forming an image on a sheet.

2. Description of the Related Art

Japanese Patent Application Laid-Open No. 2003-326680 discusses a technique in which a sheet is heated by a heater after ink is applied, to promote dryness of the sheet. The technique controls the amount of heating by increasing or decreasing the temperature of a heater according to the duty of image recording (hereinafter referred to as duty), that is, the amount of ink applied to the sheet per unit area.

An application in which a large-format advertizing poster displayed outdoor is produced by using an ink-jet printing apparatus has attracted attention. In this application, printing is performed by applying ink to a sheet high in weather resistance, such as sheet of vinyl chloride. A recording medium in a sheet form without an ink receiving layer has the property that repels water without absorbing it. For this reason, it is difficult to perform printing using a general water-based ink by a system in which ink is fixed by air drying.

For printing on a sheet without an ink receiving layer, a method is conceivable in which the ink immediately after being impacted on a print surface is heated by a heater to evaporate moisture, increasing the viscosity of the ink. An investigation is made as to whether heating control can be applied in printing on the sheet without an ink receiving layer according to the duty discussed in Japanese Patent Application Laid-Open No. 2003-326680 and the following problems to be solved are found.

(1) A first problem: Precise management of the amount of heating.

If the print surface is insufficiently heated by a heater, such a phenomenon called beading occurs that ink droplets adjacently impacted aggregate without moisture being sufficiently removed immediately after the ink is impacted to collapse an image. If the print surface is excessively heated by a heater, on the other hand, the sheet itself is expanded or contracted depending on a property of the sheet to cause damage such as creases to the sheet. Thus, for printing on a sheet without an ink receiving layer, strict temperature control on the print surface is required.

(2) A second problem: Decrease in temperature of platen and sheet due to heat of vaporization.

As illustrated in FIG. 4A, thermal energy (heat transfer from the sheet surface and heat radiation from the heater) is provided for the ink impacted on the print surface of the sheet 3 so that moisture is evaporated in a short time period. Since moisture hardly penetrates through the sheet without an ink receiving layer, the ink is deprived of its heat of vaporization when moisture of the ink evaporates, so that the temperature of the sheet 3 is lowered. Printing on a plurality of sheets is continued to lower also the temperature of the surface of the platen 2 supporting the sheet 3. The platen 2 deprives the sheet 3 to be newly supplied on the platen 2 of its temperature, so that the temperature of the sheet 3 is further lowered. As a result, a period of time required for impacted ink to evaporate is extended to dry ink droplets with the droplets further extended than an intended dot size, as illustrated in FIG. 4B. If adjacent ink droplets are mixed with each other, as illustrated in FIG. 4C, beading occurs to degrade image quality.

(3) A third problem: Follow-up delay of heater temperature.

The working temperature of the heater is 300° C. to 500° C., for example. There is a significant time lag from the heater starting drive to the heater reaching a target temperature. The use of such a heater inferior in control response causes the deficiency or excess of the heat quantity provided on the print surface not to provide uniform image quality. To avoid this, the print speed is compelled to be lowered according to the response of the heater. A heater which is small in thermal capacity and size is high in response. However, arranging a plurality of small heaters brings disadvantages in the cost and the assemblage of the apparatus. In particular, a heating area is very large in a large-format printer and a large number of small heaters are used to cover the area, thus making the disadvantages conspicuous.

SUMMARY OF THE INVENTION

The present invention is directed to a printing apparatus and a printing method which are capable of forming a high quality image by appropriately controlling a heater in printing on a sheet without an ink receiving layer.

According to an aspect of the present invention, a printing apparatus includes a printing unit capable of printing an image on a sheet without an ink receiving layer by repeating scanning of a print head, a heater configured to heat an area on the sheet to which ink is applied by the print head, and a control unit configured to control output and drive timing of the heater based on a parameter for each scanning of the print head.

According to an exemplary embodiment of the present invention, a printing apparatus and a printing method which are capable of forming a high quality image are realized by appropriately controlling the output and drive timing of a heater for each scanning of a print head based on parameters in printing on a sheet without an ink receiving layer.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
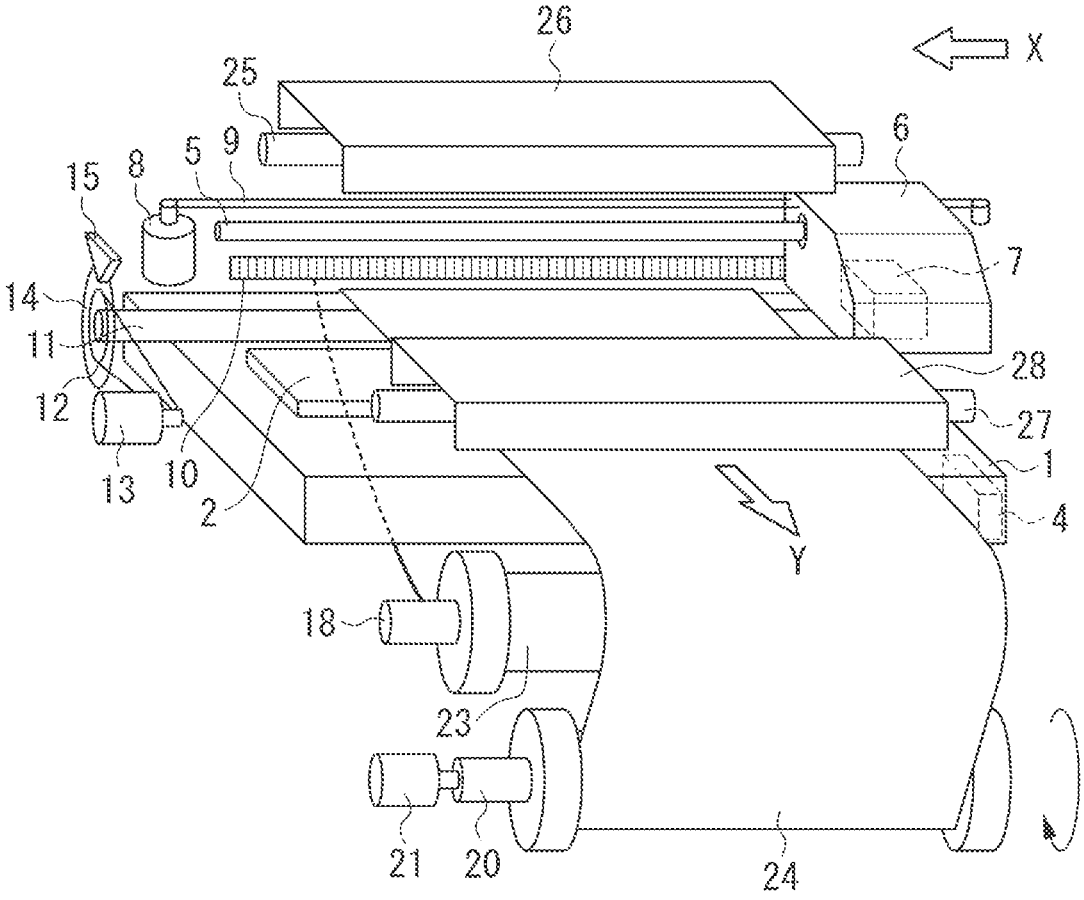
FIG. 1 is a perspective view illustrating a configuration of principal units of an inkjet printing apparatus.
Figure 2:
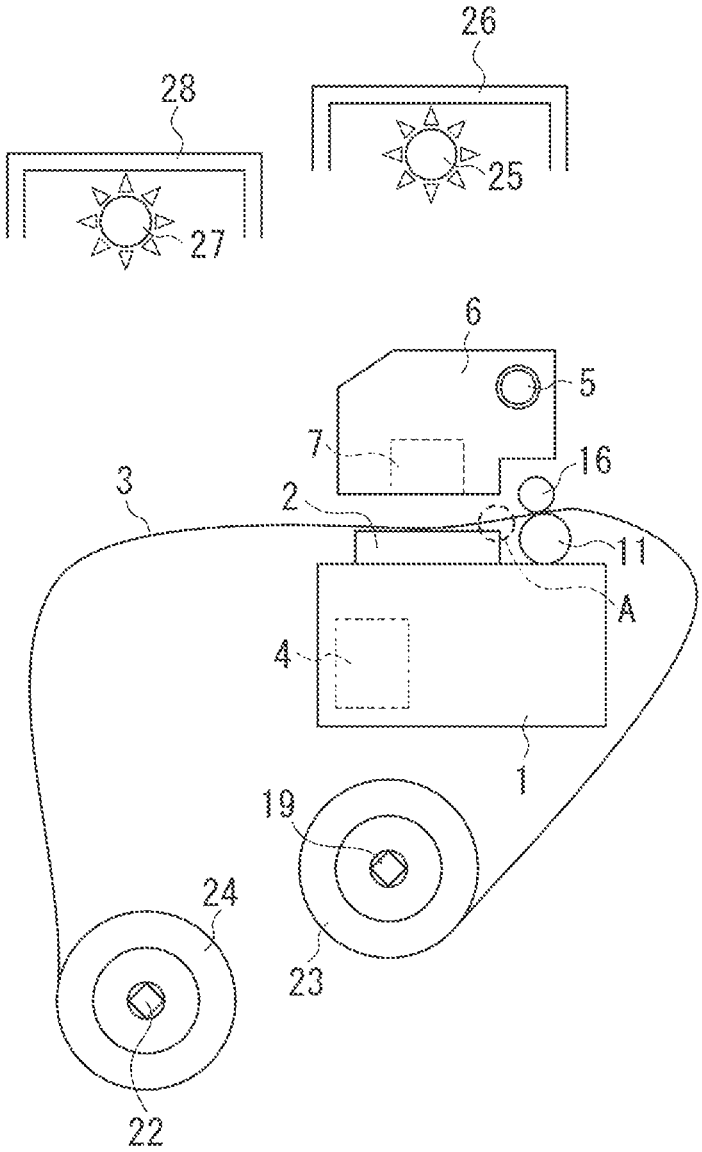
FIG. 2 is a side view illustrating a configuration of principal units of the inkjet printing apparatus.

FIG. 1 is a perspective view illustrating a configuration of principal units of an inkjet printing apparatus according to an exemplary embodiment. FIG. 2 is a side view thereof. The inkjet printing apparatus principally includes a printing unit, a sheet conveyance unit, a drying unit, and a control unit.

It is presumed that the sheet for use in the inkjet printing apparatus according to the present exemplary embodiment is the one made of water repelling vinyl chloride without a receiving layer (hereinafter referred to as sheet without a receiving layer). A general sheet with a receiving layer may be used. It is also presumed that the ink in use contains a large amount of an emulsion component with a property in which moisture in the ink is evaporated by applying heat to the sheet and the ink is softened and encapsulated. The ink is encapsulated on the sheet to allow improving weather resistance, water resistance, and scratch resistance of an image.

The printing unit forms an image in a serial print system method in which a carriage 6 repeats the reciprocal scanning of a print head 7 in the main scanning direction (X direction) on the sheet conveyed on a platen 2 in the sub-scanning direction (Y direction) by step feed.

The platen 2 is mounted on a casing 1. The casing 1 includes a suction unit 4 for suctioning a sheet 3. The carriage 6, which is reciprocated in the main scanning direction, is supported by a main rail 5 arranged along the longitudinal direction of the casing 1. The carriage 6 is provided with the inkjet print head 7. An energy generation element for discharging ink from the nozzles of the print head 7 may be any of a heating element, a piezoelectric element, an electrostatic element, and a microelectromechanical system (MEMS) element.

A carriage motor 8 is a drive source for moving the carriage 6 in the main scanning direction and the rotation driving force thereof is transmitted to the carriage 6 by a belt 9. A position where the carriage 6 is in the main scanning direction is detected by a linear encoder to be monitored. The linear encoder includes a linear encoder pattern 10 attached to the casing 1 and a reader (not illustrated) which optically, magnetically, or mechanically reads the encoder pattern 10 and is mounted on the carriage 6.

The sheet conveyance unit feeds a sheet, conveys the sheet in the printing unit, and handles the sheet at the time of collecting the sheet. A long continuous sheet of a recording medium is supplied as a roll member 23 wound onto a spool 18 in a roll shape. The spool 18 includes a torque limiter 19 for exerting a brake force (back tension) on the sheet 3. The sheet drawn out from the roll member 23 is supplied to the lower portion of the printing unit (the casing 1) from the front to the rear of the apparatus.

The sheet 3 supplied to the lower portion of the casing 1 is supplied onto the platen 2 from the rear to the front while winding the casing 1. The sheet 3 on the platen 2 is conveyed along the sub-scanning direction (direction indicated by an arrow Y in FIG. 1) orthogonal to the main scanning direction of the carriage 6. The conveyance is performed by a drive mechanism composed of a conveyance roller 11, a pinch roller 16, a belt 12, and a conveyance motor 13. The driving state (amount of rotation and rotation speed) of the conveyance roller 11 is detected and monitored by a rotary encoder. The rotary encoder includes a circular encoder pattern 14, which is rotatable with the conveyance roller 11, and a reading unit 15 for optically, magnetically, or mechanically reading the encoder pattern 14.

The sheet on which an image is printed by the print head 7 of the printing unit wound and collected by a spool 20. The sheet wound in a roll shape around the spool 20 forms a roll member 24. The spool 20 is rotated by a winding motor 21 and includes a torque limiter 22 for exerting a winding tension on the sheet 3.

If the sheet without a receiving layer is used, the drying unit radiates energy for drying the ink applied to the sheet in a short time period. The drying unit includes a first heater 25 provided immediately above the platen 2 and in a position higher than the carriage 6, and a second heater 27 provided downstream of the platen 2 in the conveyance direction and in a position higher than the carriage 6. The first and second heaters 25 and 27 are covered by heater covers 26 and 28, respectively. Each heater cover causes a mirror inside the cover to reflect the heat (infrared to far-infrared) of the heater to direct the heat toward the sheet surface and physically protects the heater.

The first heater 25 is positioned immediately above the platen 2 and radiates thermal energy to the area where the print head 7 is reciprocated. When the ink discharged from the print head 7 impacts the print surface, the carriage 6 immediately leaves there, and the applied ink is exposed to the thermal energy radiated by the heater 25. This promotes the evaporation and dry of moisture of the ink promptly after printing is performed.

The sheet area where the ink whose moisture is decreased by thermal energy of the first heater 25 is applied is conveyed downstream by step feed. The second heater 27 on the downstream side gives thermal energy to the surface of the sheet to which the ink is applied. The second heater 27 is higher in output than the first heater 25, and the thermal energy with a high temperature dissolves specific components in the ink to cover the color material of the ink. Thus, the ink is firmly fixed even to the sheet without an ink receiving layer to form an image high in weather resistance.

Figure 3:
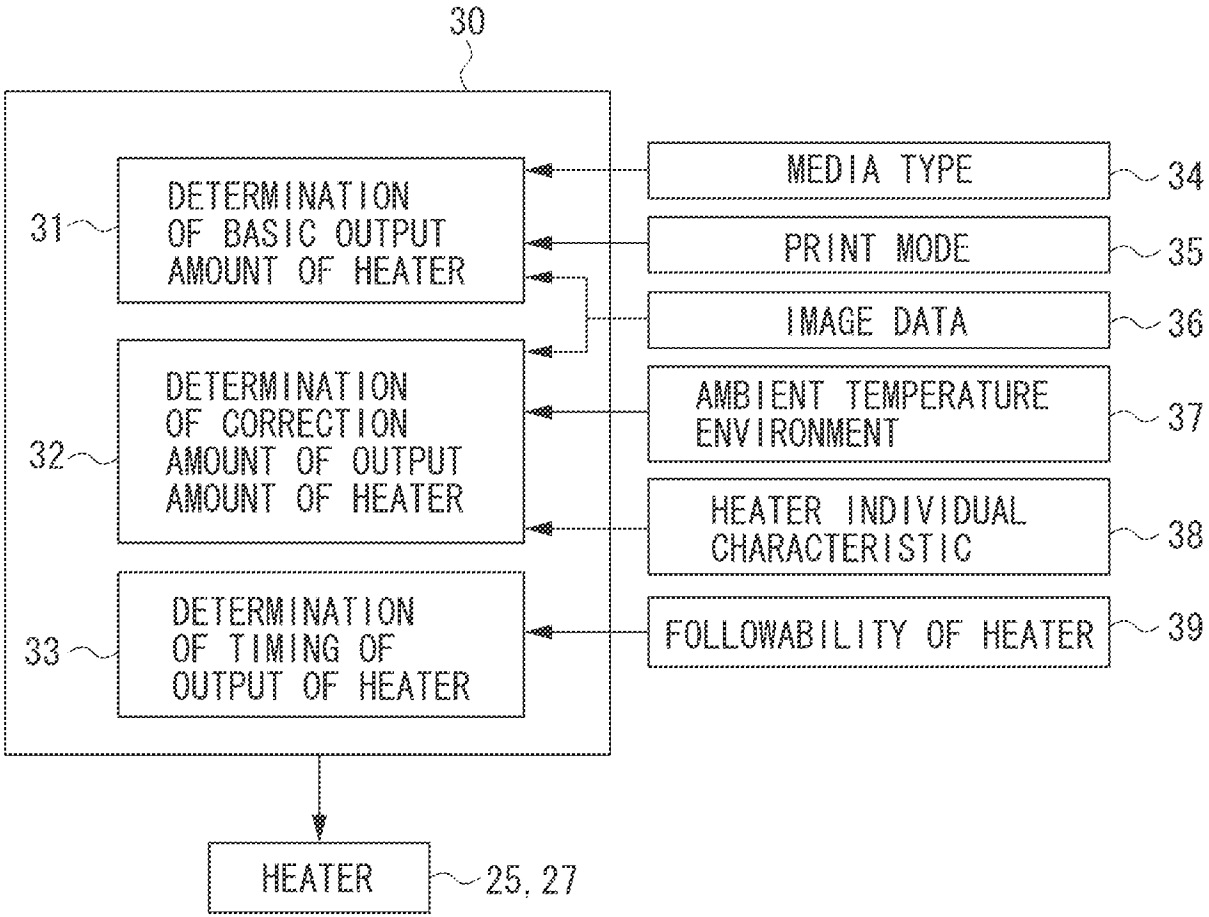
FIG. 3 is a block diagram illustrating a system configuration of a heater control unit.

The control unit for controlling the entire printing apparatus includes a control unit 30 for controlling the drive of the heater. FIG. 3 is a block diagram illustrating a configuration of the control unit 30.

The control unit 30 includes a block 31 for determining the basic output amount of the heater, a block 32 for determining the correction amount of output of the heater and a block 33 for determining the timing of starting the output of the heater. Each block has a memory serving as a storage unit for storing various types of parameters and data tables. The output and timing of the heaters 25 and 27 are controlled using the driving parameters set based on the determination of the blocks.

Various types of information or parameters for determination are input to each block. A block 34 (media type) inputs the type of media of the sheet used for printing. A block 35 (print mode) inputs print modes to be executed (one-pass print mode and multi-pass print mode). A block 36 (image data) inputs the data of an image to be printed. As described below, the duty of printing is obtained based on the image data. A block 37 (ambient temperature environment) inputs the temperature of the environment where the printing apparatus is installed. A block 38 (heater individual characteristic) inputs information about the individual characteristic of the heater incorporated in the apparatus. A block 39 (heater followability) inputs information about the followability of the heater incorporated in the apparatus.

Heating the print surface by the first and second heaters 25 and 27 needs to be appropriately managed under the control of the control unit 30. If moisture in the ink immediately after the ink is impacted is insufficient due to insufficient heating of the first heater 25, image quality may be degraded. More specifically, ink droplets are further spread than inherent ones (large dot size), or the ink droplets adjacently impacted aggregate with each other to cause a beading phenomenon, which may degrade image quality. On the other hand, if the first and second heaters 25 and 27 excessively heat, a sheet weak against heat is expanded or contracted by heat to cause damage such as creases or waves.

To solve these problems, the present exemplary embodiment performs the following heater control to control the temperature of the print surface.

1. Duty and media type.

For an image high in average duty (an index indicating the amount of ink discharged onto a unit area), the output of a heater for promoting the evaporation of moisture of the ink on a print surface is relatively increased because a large amount of ink is applied to the sheet. On the other hand, for an image low in average duty, the output of the heater is relatively decreased to prevent the sheet from being damaged due to heating significantly exceeding heat quantity required to dry the ink.

Even if the duty is the same, the amount of heating required for drying is different according to the media type of a sheet in use. Then, an appropriate heater output according to the media type and the duty (a plurality of steps) is previously acquired by an experiment and stored in the memory of the control unit as a data table. In addition to the data table, a calculation formula whereby to obtain the same result may be prepared to acquire an appropriate heater output by calculation.

Table 1 is an example of a data table. The table indicates optimum heater outputs (%) for each duty divided into four ranges (0% to less than 25%, 25% or more and less than 50%, 50% or more and less than 75%, 75% or more and less than 100%) with respect to three different types of media (media A, B, and C).

TABLE 1

| | Duty | | | |
|---|---|---|---|---|
| Media type | 25% | 50% | 75% | 100% |
| Media A | 40 | 55 | 70 | 80 |
| Media B | 35 | 40 | 50 | 60 |
| Media C | 40 | 50 | 60 | 70 |

The heater output refers to an output ratio with the maximum output as 100%. If the heater is driven by repeating turning on and off the heater, the heater output refers to the ratio of ON to the total number of repeats. When the ratio of ON to OFF in the heater in any cycle is 7 to 3, the heater output is 70%.

The control unit obtains an average duty for each one record band in a serial print. The average duty can be obtained by calculation based on area data corresponding to one band among recording images to be printed. The control unit obtains a heater output for one band with reference to the data table based on the duty obtained from the media type and the image data in use. In an example of Table 1, the heater output in a case where an image with an average duty of 70% is recorded on the sheet B is 70%.

In this example, the average duty of one band is taken as a parameter. However, as described below, the duty for each area in one band may be obtained to set the heater output based on the maximum duty.

In the midst of printing of one record band, the duty of the next record band is similarly calculated to reset the optimum heater output with reference to the data table. Thus, the heater output is set for each one record band in the serial print to complete printing of one image. The cores of the above processing are the blocks 31 and 32 of the control unit 30 and the blocks 34 to 36 in FIG. 3.

2. Decrease in temperature due to heat of vaporization.

Even though the heater output is set according to the duty as described above, the temperature of a surface of the sheet is decreased beyond the scope of assumption due to heat of vaporization of the ink, which may lead to insufficient dryness.

Figure 4A:
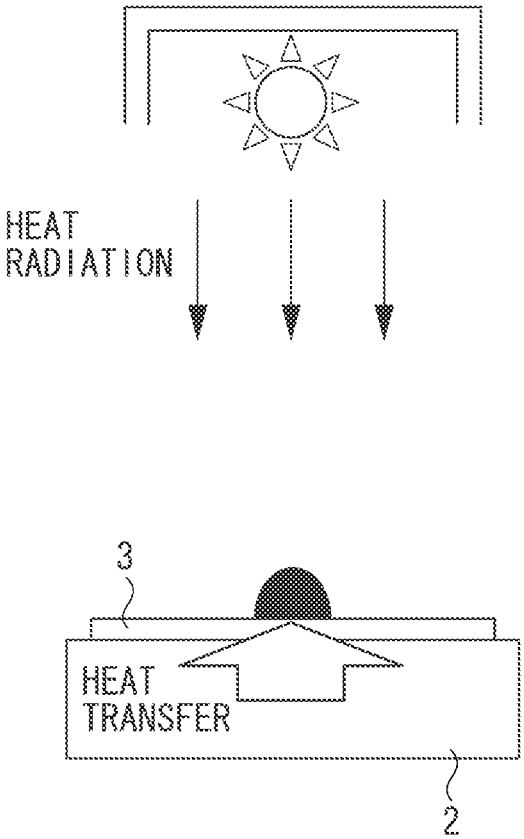
FIGS. 4A, 4B, and 4C are schematic diagrams illustrating a state where ink is impacted on the surface of a sheet.

As illustrated in FIG. 4A, after the ink is impacted on the ink print surface, the moisture thereof is evaporated and dried by in a short time period. The thermal energy mentioned above includes heat transfer from the heated sheet itself as well as the heat directly provided by the heater. Heat of vaporization is generally determined according to the media type of the sheet.

Figure 4B:
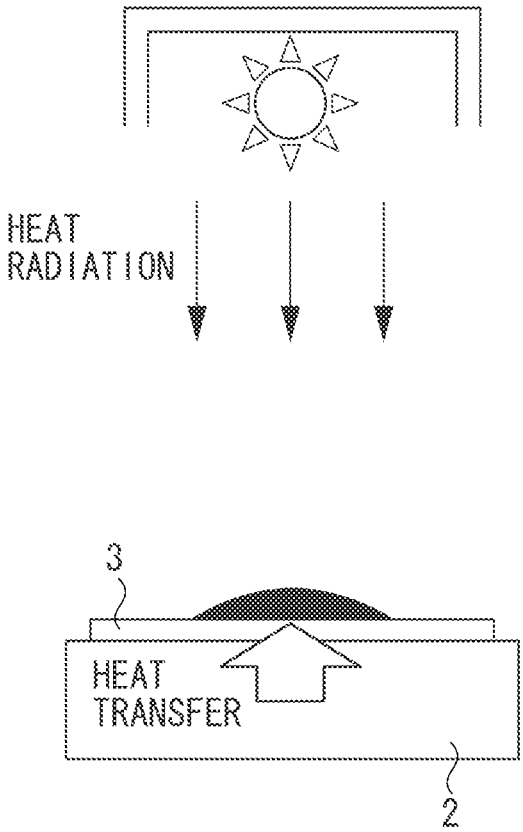
Figure 4C:
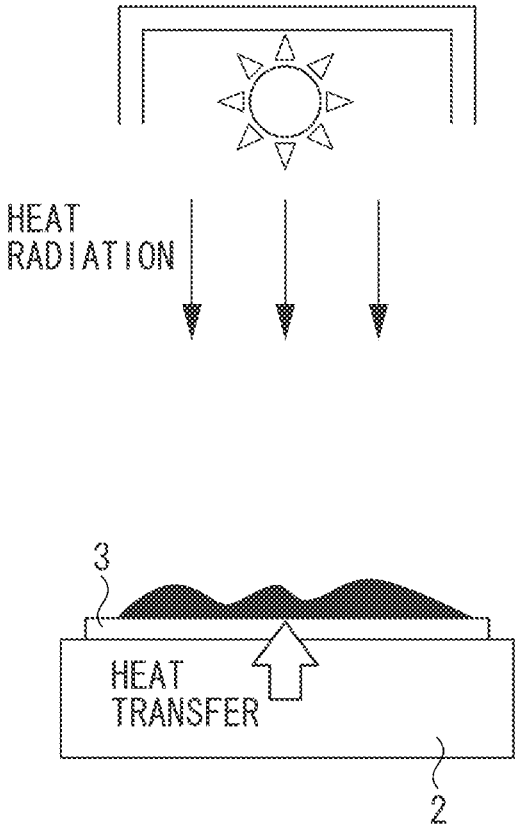

If the sheet in use does not have an ink receiving layer, the moisture of the ink hardly permeates the sheet surface, so that the ink is deprived of its heat of vaporization when moisture of the ink evaporates. Printing on a plurality of sheets is continued to lower the temperature of the sheet by the heat of vaporization and also the temperature of a surface of the platen supporting upward the sheet. Decrease in the temperature of the platen decreases also the temperature of the surface of the sheet supported there. As a result, a period of time required for impacted ink to evaporate is extended to dry the applied ink droplets with the droplets extended to the sheet surface as illustrated in FIG. 4B. This forms a dot in which a color material is formed larger than an inherent one, which results in degradation of an image. Further decrease in temperature may cause beading as illustrated in FIG. 4C.

The problem of a decrease in temperature due to the heat of vaporization is solved such that, if the duty in a certain range continues for a while, offset is performed to increase the heater output according to the continuous time period, thus performing correction. The control unit estimates a decrease in temperature of the sheet surface and corrects the heater output to compensate for the decrease in temperature on the sheet surface.

More specifically, the control unit previously acquires correction values (offset values) of the heater different according to the continuous time period from an experiment with respect to a plurality of duties and stores the correction values as a data table in the memory thereof. Aside from the data table, a calculation formula from which the same result can be obtained may be prepared to obtain an appropriate heater output correction value from calculation.

Table 2 is an example of a data table of heater correction values (addition %). The table indicates corresponding plus correction values (addition %) of the heater for each of the continuous time periods of 3 minutes, 5 minutes, 10 minutes, and 15 minutes with respect to each of three different types of duties (less than 80%, 80% to 90%, and 90% to 100%).

TABLE 2

| | Continuous time | | | |
|---|---|---|---|---|
| Duty | 3 min | 5 min | 10 min | 15 min |
| 80% | 3 | 4 | 6 | 8 |
| 90% | 7 | 8 | 10 | 12 |
| 100% | 9 | 11 | 13 | 15 |

For example, if it is predicted that printing of an image with a duty of 80% is continued for 10 minutes, the heater output is increased by 6% with respect to an initial value. The correction value of the heater output may be set according to each of integrated values of the duty and the time.

The heater output may be set such that the quantity of heat of vaporization to be lost and the quantity of heat provided for the sheet are estimated and the quantity of heat exceeding the quantity of heat of vaporization lost in one carriage scanning is provided for a waiting time between the first and the second scanning. The quantity of heat of vaporization can be obtained from the amount of impacted ink (duty) and the heat of evaporation. The quantity of heat which the heater provides for the sheet surface can be obtained by calculation based on heater temperature, heater area, distance between objects, and emissivity.

Thus, the control unit performs correction to increase the heater output with reference to the data table so that a decrease in temperature of the sheet due to heat of vaporization of the ink is compensated for. The cores of the above processing are the blocks 31 and 32 of the control unit 30 and the blocks 34 to 36 in FIG. 3.

3. Follow-up delay of heater (time lag).

The heater in use is a single heating member core with a large quantity of heat and a length corresponding to a wide large-format sheet. A working temperature ranges from approximately 300° C. to 500° C. The use of the heater with such a large quantity of heat causes a significantly time delay (follow-up delay) until the heater reaches a target temperature after instructions for the heater output are changed. In changing the heater output for each band according to the duty, a heater inferior in control response cannot follow up temperature, so that the print surface may deviate from a desired temperature.

Figure 5A:
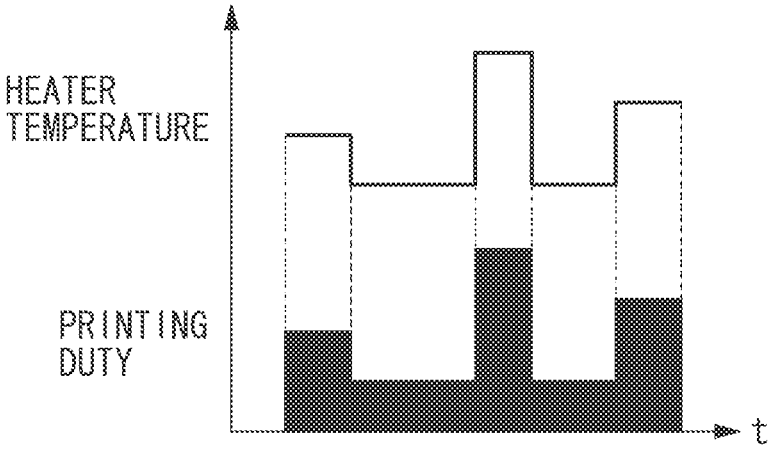
FIGS. 5A, 5B, 5C, and 5D are graphs illustrating a time-series relationship between duty and heater temperature.
Figure 5B:
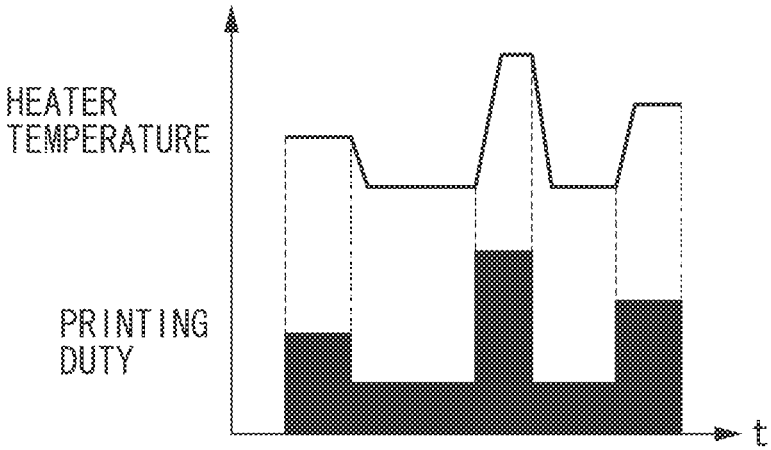

The above problem can be solved by performing control so that the drive of the heater is previously started in consideration of delay in temperature follow-up of the heater. FIGS. 5A, 5B, 5C, and 5D are graphs illustrating a time-series relationship between duty and heater temperature. FIG. 5A illustrates an idealistic state of transition of heater temperature with respect to the duty. The heater temperature momentarily shifts to a target temperature at the same time of switching. Actually, however, such a shift does not occur, and the follow-up delay of the heater temperature occurs as illustrated in FIG. 5B. In other words, a time lag occurs until the heater reaches the target temperature after instructions for changing the heater temperature are provided. For this reason, printing is performed while the print surface does not yet reach the target temperature, which may cause deterioration of an image.

Figure 5C:
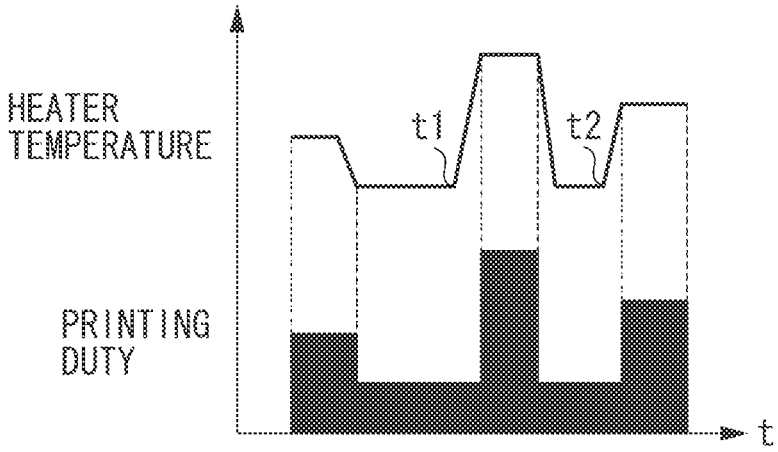

In consideration of such an issue, the target temperature of the heater is set in advance in anticipation of the time lag. As illustrated in FIG. 5C, the target temperature is changed at times t1 and t2 in advance of the switch timing of the duty in anticipation of the follow-up delay of the heater to increase the heater output. Thereby, the target temperature can be obtained at the switch timing of the duty and a good image can be formed on the print surface. In this example, previous control is not performed if the heater output is changed to decrease the target temperature. For this reason, if the fall of the target temperature is large in switching, temperature does not completely fall to its target depending on places. However, there is no problem because the temperature is not excessively high enough to damage the sheet. Also, if the target temperature is lowered, control may be performed to change the heater output in advance.

Information about the followability of the heater (time lag) in switching the target temperature is previously measured for each media type to be presumably used and stored in the memory of the control unit. More specifically, the temperature of the sheet surface in a blank area (a position A in FIG. 2) at the very front of the print position is measured using a temperature sensor. The period of time lag is measured by a timer from a state where temperature is stabilized by the heater output at any target temperature to a state where the sheet reaches a stable temperature after the heater output is switched to obtain another target temperature. The measurement on various target temperatures is carried out to acquire the information. Similarly, the measurement on each of a plurality of media types to be presumably used is carried out to acquire the information. The information is stored in the memory of the control unit as a data table. In an actual printing operation, the control unit sets the target temperature of the heater in advance by only the time lag with reference to the time table as indicated by times t1 and t2 illustrated in FIG. 5C.

The cores of the above processing are the blocks 31 and 33 of the control unit 30 and the blocks 34 to 36 and 39 in FIG. 3.

4. Individual difference in heater.

Figure 6:
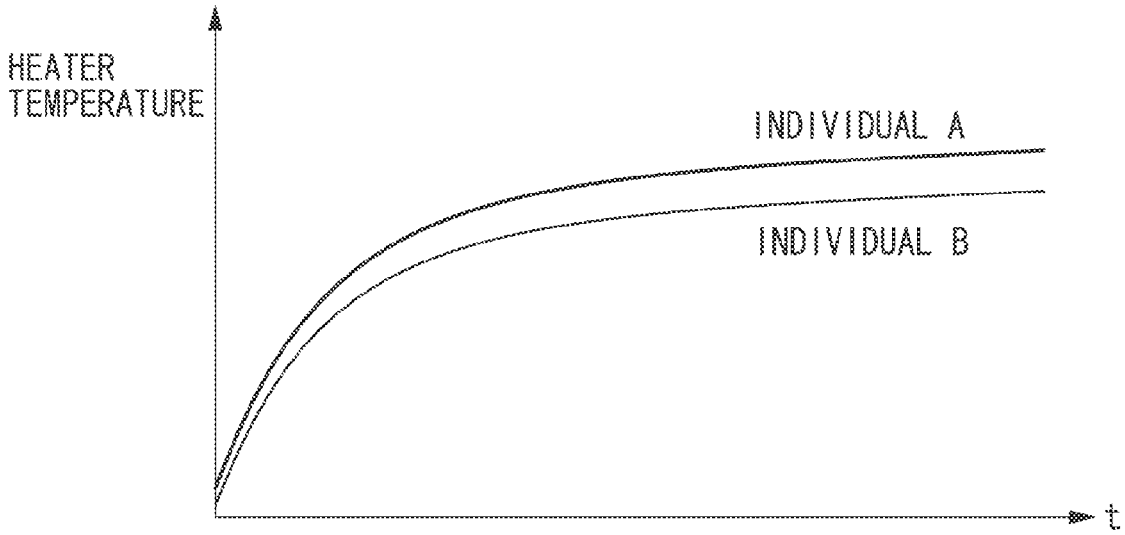
FIG. 6 is a graph indicating a change in heater temperature in a case where there is a difference between heater individuals.

The characteristic of a heater mounted on the apparatus is not always constant. The characteristic can be different depending on an individual owing to dispersion in manufacture or deterioration caused by use for a long period. FIG. 6 is a graph indicating heater temperatures changing after the drive of heater individuals A and B is started. The individuals A and B are different in characteristic.

The problem of individual difference can be solved such that the characteristic of the heater serving as a reference is estimated and displacement from the characteristic is acquired, offset, and calibrated. The graphs described above are acquired based on the reference heater. The apparatus is driven under the same condition as the above to acquire a difference with the reference and the reference is offset to perform calibration. The calibration can be performed at a time when the apparatus is assembled, at a period when an unallowable change in the characteristic of the heater is anticipated, and at a time when the apparatus is used.

Thus, the control unit corrects any one of the heater output and drive timing based on the individual difference in the heater. The cores of the above processing are the blocks 31 to 33 of the control unit 30 and the blocks 34 to 36 and 38 in FIG. 3.

5. Change in ambient environment.

Figure 7:
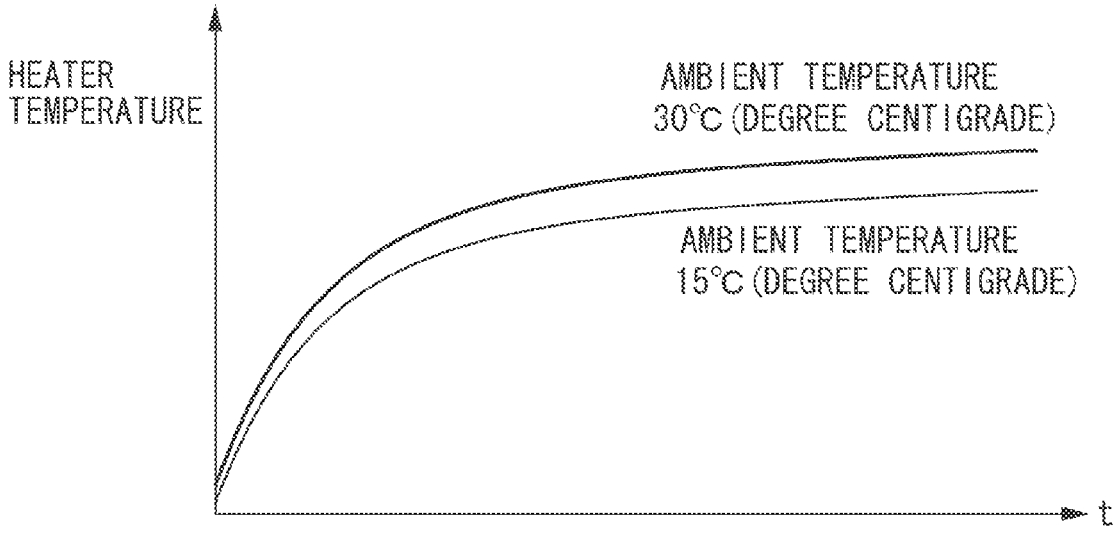
FIG. 7 is a graph indicating a change in heater temperature in a case where ambient temperature is different.

Even though a certain target temperature is set and the heater is driven, an actual heater temperature can be changed by the influence of ambient temperature. FIG. 7 is a graph indicating heater temperatures changing after drive is started for each of ambient temperatures 30° C. and 15° C. Even if the similar driving is performed, changes in ambient temperature change the graph characteristic. For example, even if a time lag occurs as illustrated in FIG. 5B when ambient temperature is 30° C., the time lag becomes greater if the ambient temperature is lowered to 15° C.

Figure 5D:
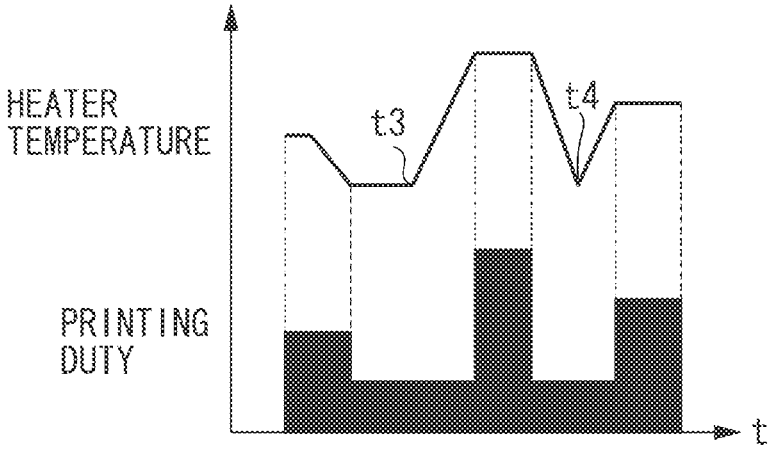

This problem can be solved such that, at an ambient temperature of 30° C., a heater drive timing is set at times t1 and t2 illustrated in FIG. 5C and, at an ambient temperature of 15° C., setting is changed according to the ambient temperature so that the heater drive timing further precedes at times t3 and t4 illustrated in FIG. 5D. Setting may be performed so that the lower the temperature of ambient environment, the higher the target temperature. The heater drive timing may be changed according to changes in ambient temperature.

Thus, the control unit corrects any one of the heater output and drive timing according to the ambient temperature environment. The cores of the above processing are the blocks 31 to 33 of the control unit 30 and the blocks 34 to 36 and 37 in FIG. 3.

Figure 8:
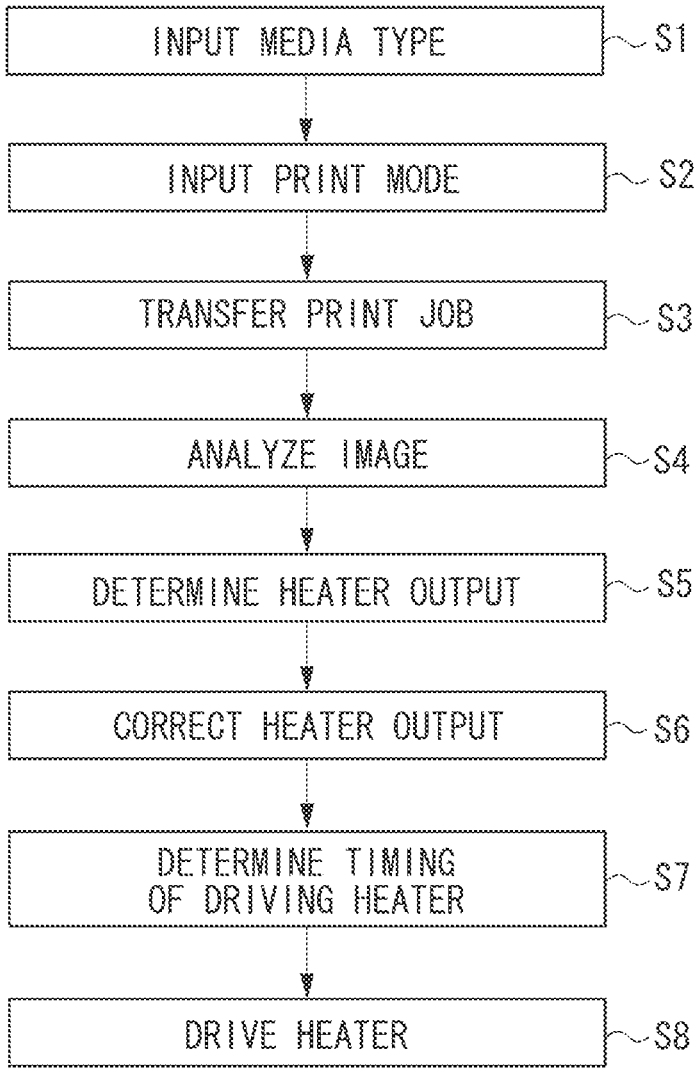
FIG. 8 is a flow chart illustrating a sequence of heater control.

FIG. 8 is a flow chart illustrating a sequence of heater control performed by the control unit 30 to implement the foregoing concept.

In step S1, the media type of a sheet used for printing is input to the control unit 30 from the block 34. In step S2, a print mode to be executed in printing is input to the control unit 30 from the block 35. The print mode includes information such as the number of passes in multi-pass print, a carriage speed, and a sheet conveyance speed. In step S3, a print job including image data of an image to be printed is transferred via the block 36.

In step S4, the control unit 30 analyzes the image data to obtain the amount of ink per unit area (duty) discharged in forming an image during scanning of one band.

In step S5, the heater output is determined based on the duty obtained in step 4, the media type input in step S1, and the print mode input in step S2. In step S6, the heater output is corrected according to information about the difference in heater individual input from the block 38, the ambient temperature environment input from the block 37, and the heat of vaporization determined according to the type of the sheet. In step S7, the heater drive timing is determined in consideration of information about the follow-up delay of the heater input from the block 39.

In step S8, the heater is driven based on the heater output and the drive timing set in steps S7 and S8. The above heater control is performed for each scanning of one band in the serial print.

The heater used in the present exemplary embodiment is made of a long and thin single heating member core, so that the temperature distribution in the sheet width direction cannot be set arbitrarily. If there are both areas high and low in duty in one band, the heater output is set to the area high in duty. The reason is that an area where ink is insufficiently dried is liable to cause the deterioration of an image such as beading. If a difference in duty in one band is very large, the area which is the lowest in duty may be excessively heated. However, such a case is rare, so that priority is placed on preventing the ink from being insufficiently dried. The heater may be divided into a plurality of heating member cores instead of the single heating member core, and each of the divided cores may be individually controlled.

According to the present exemplary embodiment described above, the output and drive timing of the heater are appropriately controlled for each scanning of a print head based on parameters in printing on a sheet without an ink receiving layer. The parameters used herein refer to one or a plurality of pieces of information about a duty of an image to be printed in one scanning, a print mode, the type of a sheet in use, a decrease in sheet temperature due to the heat of vaporization of ink, a control follow-up delay of heater temperature, an individual difference in heater characteristic, and the temperature of environment where the apparatus is installed. Accordingly, a printing apparatus and a printing method capable of forming a high quality image can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-166762 filed Jul. 29, 2011, which is hereby incorporated by reference herein in its entirety.

What is claimed is:

1. A printing apparatus comprising:

a printing unit capable of printing, by repeating scanning of a print head, an image on a sheet without an ink receiving layer that absorbs ink;

a heater configured to heat an area on the sheet to which ink is applied by the print head; and a control unit configured to control output and drive timing of the heater for each scanning of the print head, wherein the control unit corrects one of the output and the drive timing of the heater based on at least one of an individual heater characteristic of the heater and a temperature of environment where the printing apparatus is installed.

2. The printing apparatus according to claim 1, wherein the heater includes a heating member that is long in a width direction of the sheet and that is configured to give thermal energy toward a surface of the sheet to which ink is applied by the print head.

3. The printing apparatus according to claim 2, wherein the heater is arranged above the print head within a range in which the print head moves.

4. The printing apparatus according to claim 1, wherein the control unit controls the heater using one or a plurality of pieces of information about a duty of an image to be printed in one scanning, a print mode, a type of a sheet in use, a decrease in sheet temperature due to heat of vaporization of ink, and follow-up delay of heater-temperature control.

5. The printing apparatus according to claim 1, wherein the ink contains an emulsion component.

6. A printing apparatus comprising:

a printing unit capable of printing, by repeating scanning of a print head, an image on a sheet without an ink receiving layer that absorbs ink;

a heater configured to heat an area on the sheet to which ink is applied by the print head; and a control unit configured to control output and drive timing of the heater for each scanning of the print head, wherein the control unit includes a storage unit configured to store an output of the heater suited for a combination of a type of the sheet and a duty with the type of the sheet and the duty set as a parameter and, wherein the control unit controls the heater for each scanning of the print head to provide an output obtained by referring to the storage unit.

7. A printing apparatus comprising:

a printing unit capable of printing, by repeating scanning of a print head, an image on a sheet without an ink receiving layer that absorbs ink;

a heater configured to heat an area on the sheet to which ink is applied by the print head; and a control unit configured to control output and drive timing of the heater for each scanning of the print head, wherein the control unit includes a storage unit configured to store information about a follow-up delay of heater-temperature control with respect to drive of the heater, and wherein the control unit controls the heater for each scanning of the print head to advance drive timing based on information obtained by referring to the storage unit.

8. A printing apparatus comprising:

a printing unit capable of printing, by repeating scanning of a print head, an image on a sheet without an ink receiving layer that absorbs ink;

a heater configured to heat an area on the sheet to which ink is applied by the print head; and a control unit configured to control output and drive timing of the heater for each scanning of the print head, wherein the control unit performs correction to increase the output of the heater to compensate for a decrease in temperature of the sheet due to heat of vaporization of the ink.

9. The printing apparatus according to claim 8, wherein the control unit includes a storage unit configured to store correction values for the heater different according to a continuous time period with respect to a plurality of duties, and wherein the control unit controls the heater to increase the output thereof based on information obtained by referring to the storage unit.

10. A printing apparatus comprising:

a printing unit capable of printing, by repeating scanning of a print head, an image on a sheet without an ink receiving layer that absorbs ink;

a heater configured to heat an area on the sheet to which ink is applied by the print head; and a control unit configured to control output and drive timing of the heater for each scanning of the print head, wherein the control unit sets the output of the heater based on an average duty of an image to be printed in one scanning or a maximum duty among a plurality of areas included in an image to be printed in one scanning.

11. A printing method comprising:

printing, by repeating scanning of a print head, an image on a sheet without an ink receiving layer that absorbs ink;

heating, via a heater, an area on the sheet to which ink is applied by the print head; and controlling output and drive timing of the heater for each scanning of the print head, wherein controlling includes correcting one of the output and the drive timing of the heater based on at least one of an individual heater characteristic of the heater and a temperature of environment where the printing apparatus is installed.

* * * * *